US008120453B2

(12) United States Patent
Preaux

(10) Patent No.: US 8,120,453 B2
(45) **Date of Patent: *Feb. 21, 2012**

(54) PORTABLE LIGHT SYSTEM HAVING A SEALED SWITCH

(76) Inventor: Brian Preaux, Alexandria, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/830,718

(22) Filed: Jul. 6, 2010

(65) Prior Publication Data

US 2011/0025437 A1 Feb. 3, 2011

Related U.S. Application Data

(63) Continuation of application No. 11/835,863, filed on Aug. 8, 2007, now Pat. No. 7,755,461, which is a continuation of application No. 10/829,425, filed on Apr. 22, 2004, now Pat. No. 7,256,671.

(60) Provisional application No. 60/464,734, filed on Apr. 24, 2003.

(51) Int. Cl.
*H01H 9/00* (2006.01)

(52) U.S. Cl. ..... 335/207; 335/205

(58) Field of Classification Search ..... 335/205–207; 362/157, 189, 200–208

See application file for complete search history.

(56) References Cited

U.S. PATENT DOCUMENTS

| | | | |
|---|---|---|---|
| 2,498,683 | A | 2/1950 | Hubbell |
| 3,898,450 | A | 8/1975 | Kilby |
| 4,152,755 | A | 5/1979 | Trosper et al. |
| 4,225,906 | A | 9/1980 | Gulliksen et al. |
| 4,760,504 | A | 7/1988 | Schaller et al. |
| 4,803,605 | A | 2/1989 | Schaller et al. |
| 6,386,730 | B1 | 5/2002 | Matthews |
| 6,802,621 | B2 | 10/2004 | Adeler |
| 2009/0080183 | A1 | 3/2009 | Opolka |

OTHER PUBLICATIONS

Cap Lamps—Koehler Wheat Electric Cap Lamps, Dec. 2004.
TAG-Lite Headlamp Systems, 1993.
Speleo Technics (Caving and Fishing Applications), 2003.
PETZL—Zoom Halogene—4.5 Headlamp with Halogen Bulb, 1981.
PETZL—Duo LED 14, Aug. 30, 2002.
StenLight—Advanced Lighting Products, 2005.

*Primary Examiner* — Bernard Rojas
(74) *Attorney, Agent, or Firm* — Duane S. Kobayashi

(57) ABSTRACT

An improved switch interface is provided that does not rely on direct contact by the user interface element to the switch apparatus. This feature enables the switch to be enclosed within a housing, thereby improving reliability and longevity of the switch mechanism.

18 Claims, 10 Drawing Sheets

PORTABLE LIGHT SYSTEM HAVING A SEALED SWITCH

This application is a continuation of non-provisional patent application Ser. No. 11/835,863, filed Aug. 8, 2007 now U.S. Pat. No. 7,755,461, which is a continuation of application Ser. No. 10/829,425, filed Apr. 22, 2004, now U.S. Pat. No. 7,256,671, issued Aug. 14, 2007. This application also claims priority to provisional application No. 60/464,734, filed Apr. 24, 2003. The above-identified applications are each incorporated herein by reference in their entirety.

BACKGROUND

1. Field of the Invention

The present invention relates generally to switches and, more particularly, to a light having a sealed switch interface.

2. Introduction

Current light switch designs for flashlights include toggle, rotary, slide or push button switches. In each of these designs, the manufacturer often tries to seal the switch from exposure to the elements. This exposure to the elements leads to corrosion of the contacts, which in turn leads to switch failure. To accomplish the task of sealing the switch, the manufacturer houses the switch inside of the light housing with the user interface protruding through the housing. For toggle and push button switches, a membrane is used to protect the switch. For switches that include a protruding knob or bezel, an o-ring is used to provide a seal. The slide switch provides no protection at all. The shortcomings of these designs include tearing of the membrane or abrasion of the o-ring, which results in a non-waterproof environment for the switch. Other shortcomings to these switch designs include small user interfaces, exclusive use of either right or left hand operation and switch stops that are easily damaged, corroded or clogged.

SUMMARY

A portable light system having a sealed switch, substantially as shown in and/or described in connection with at least one of the figures, as set forth more completely in the claims.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION

Various embodiments of the invention are discussed in detail below. While specific implementations are discussed, it should be understood that this is done for illustration purposes only. A person skilled in the relevant art will recognize that other components and configurations may be used without parting from the spirit and scope of the invention.

As noted, conventional light switch designs are deficient in their inability to shield the light switch from exposure to the elements. In accordance with the present invention, a light switch mechanism is provided that contains the light switch in a sealed housing, thereby ensuring that exposure of the housing to the elements will not affect the operation of the light switch itself. Control of the switch is effected through a switching interface element that remains external to the sealed housing during manipulation by the user. Puncturing of the sealed housing is therefore prevented.

Figure 1:
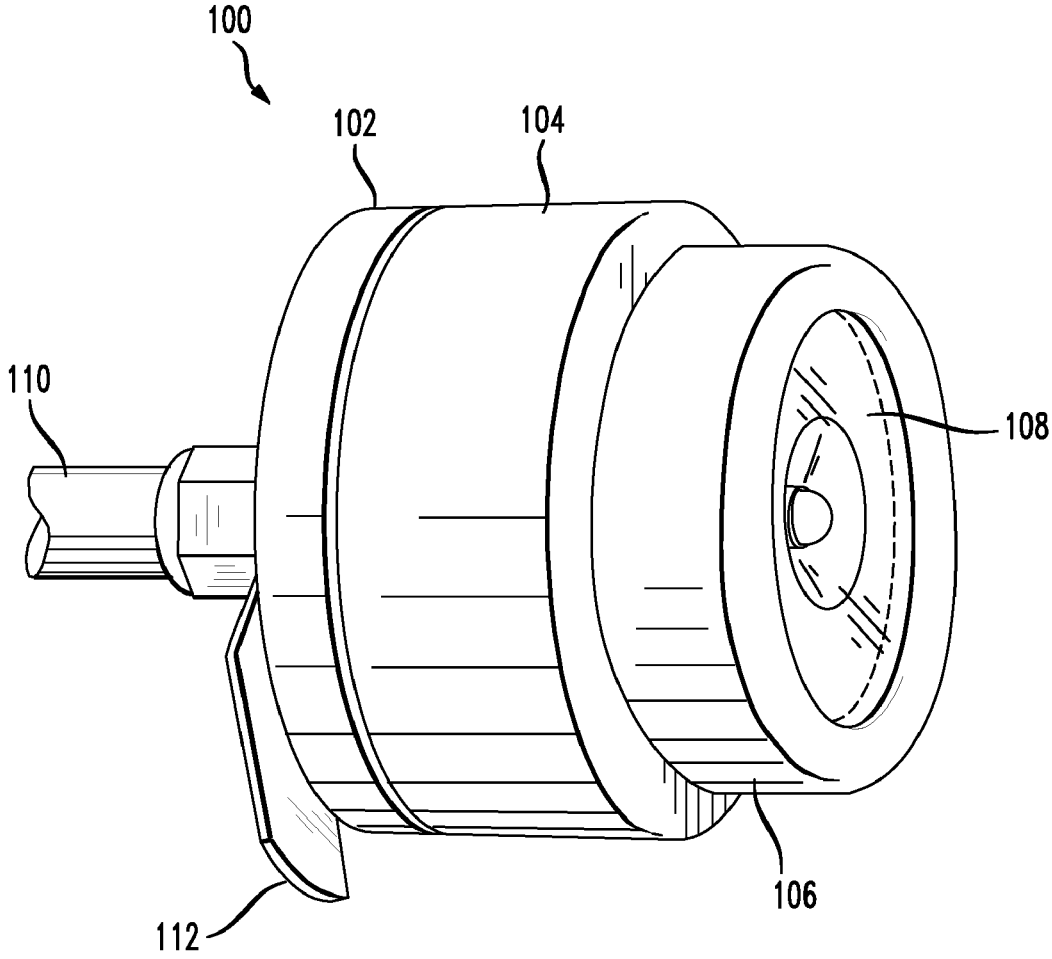
FIG. 1 illustrates an embodiment of a portable light.

FIG. 1 illustrates an embodiment of a portable sealed light that includes a light switch mechanism according to the present invention. As illustrated, portable sealed light 100 includes housing 102, switching ring 104, lens 108 and lens cap 106. In one embodiment, housing 102 contains a light emitting diode (LED) array and a spot bulb.

Switching ring 104 is generally operative to control switching elements that reside in housing 102 without requiring a direct connection between a switch activating element in switching ring 104 and a switch element in the interior of housing 102. In accordance with this feature of the present invention, housing 102 can then be environmentally sealed, thereby shielding the switching elements within housing 102 from corrosive and otherwise destructive effects in the environment of use.

As will be described in greater detail below, in one embodiment, the switching elements contained within housing 102 are magnetic switches that are activated by a magnet that is fixed in switching ring 104. In this arrangement, movement of switching ring 104 into a position that brings the magnet within sufficient proximity of a magnetic switch serves to activate that magnetic switch. An operational mode of portable sealed light 100 can therefore be changed based on the activation of that switch. As would be appreciated, a plurality of switches can be included within housing 102 to thereby initiate a change to a plurality of operational modes.

Housing 102 can be sealed in a variety of ways. In one embodiment, lens 108 is affixed to housing 102 using an adhesive/sealant. Lens cap 106 would provide further support in assuring that lens 108 remains affixed to housing 102. In another embodiment, the seal for housing 102 includes an o-ring that is compressed between housing 102 and the lens cap assembly. In general, since lens cap 106 is not part of the switching mechanism it is not rotated repeatedly. This would ensure that an o-ring would not receive excess wear and tear, which in turn maintains a waterproof housing.

User control of portable sealed light 100 is enabled through switching ring 104 that fits over a cylindrical portion of circular housing 102. As noted, in one embodiment, switching ring 104 incorporates a magnet that is use to activate magnetic switches within housing 102. This non-invasive switching mechanism ensures that housing 102 remains environmentally sealed. Significantly, the switching ring of the embodiment of FIG. 1 can be designed to be large enough to operate with impaired hands (e.g., gloved, muddy or injured). Also, a circular switching ring configuration makes it easy to operate the user interface with either hand.

As further illustrated in FIG. 1, portable sealed light 100 includes mounting bracket 112 for affixing portable sealed light 110 to a headband, helmet, bicycle, etc. and power cord 110 that is used to power electronics contained within housing 102. An embodiment of a electronic circuit that can be used to control the various operational modes using switching ring 104 is described in greater detail below with reference to FIGS. 8A and 8B.

Figure 2:
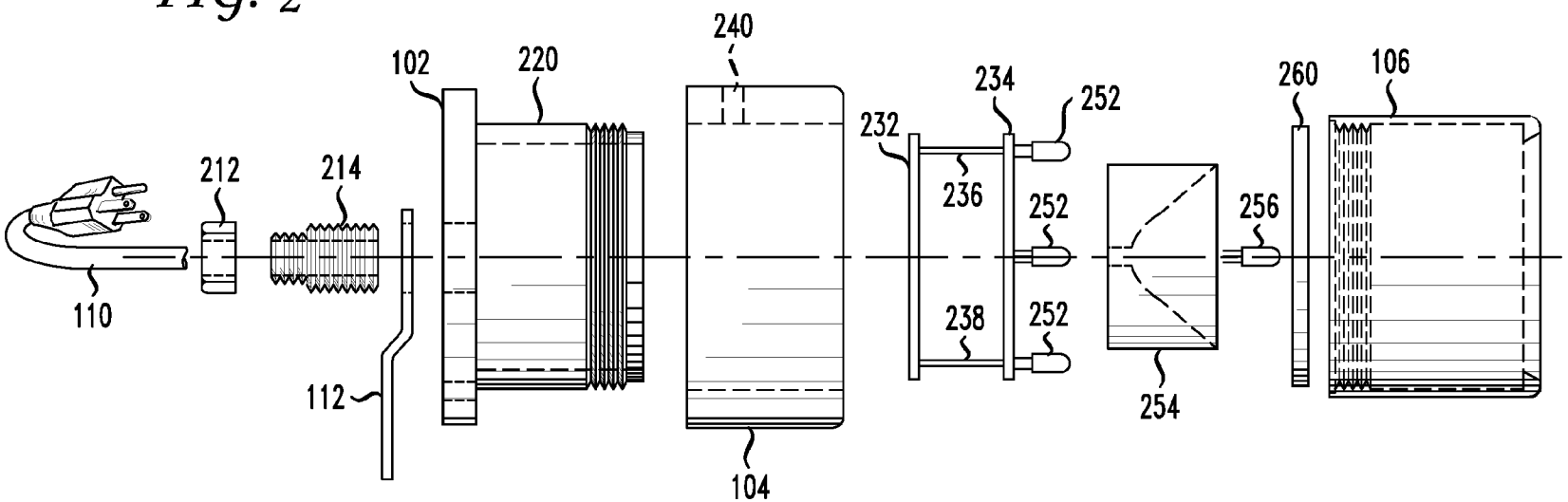
FIG. 2 illustrates an exploded view of an embodiment of a portable light.

To further describe the structure of portable sealed light 100, reference is now made to FIG. 2, which illustrates an exploded view of portable sealed light 100. As illustrated, power cord 110 is coupled to housing 102 through cable grip 212 and cable grip nut 214. Housing 102 also includes cylindrical portion 220 upon which switching ring 104 rests. Contained within housing 102 is circuit board assembly 230.

In one embodiment, circuit board assembly 210 is comprised of circular PC board 232, circular PC board 234, and PC boards 236 and 238. In addition to the inclusion of electronics and other conductors to couple circular PC board 232 to circular PC board 234, PC boards 236 and 238 also provide a support function in maintaining the structural integrity of circuit board assembly 210.

In one embodiment, circular PC board 232 includes magnetic switches that are positioned near the perimeter of circular PC board 232. These magnetic switches are selectively activated when activation magnet 240 is moved radially around circular PC board 232 through the movement of switching ring 104. When activation magnet 240 is brought into a close enough proximity to a magnetic switch that switch is then closed. Circular PC board 234, on the other hand, includes sockets and other electronic connections that enable powering and support for LEDs 252, parabolic reflector 254 and spot bulb 256.

As would be appreciated, the particular design of circuit board assembly 210 would be dependent on the shape (e.g., cylindrical, rectangular, etc.) and overall size of housing 102. Thus, the specific location and orientation of system components in circuit board assembly 210 would be implementation dependent. In general, it is envisioned that the switch elements in circuit board assembly 210 are located in positions that would enable discrete activation through the movement of a switch activation element in a user interface element that is configured to move relative to a surface of housing 102. The features of the present invention are therefore not dependent on the specific shape of housing 102 or the user interface element that is designed to cooperate with housing 102.

Finally, as further illustrated in FIG. 2, circuit board assembly 210 is secured in housing 102 using washer 260 and lens cap assembly 106. As noted, it is a feature of the present invention that housing 102 can be environmentally sealed. Thus, the particular method by which circuit board assembly 210 is enclosed in housing 102 using lens cap assembly 106 would be implementation dependent.

Figure 3A:
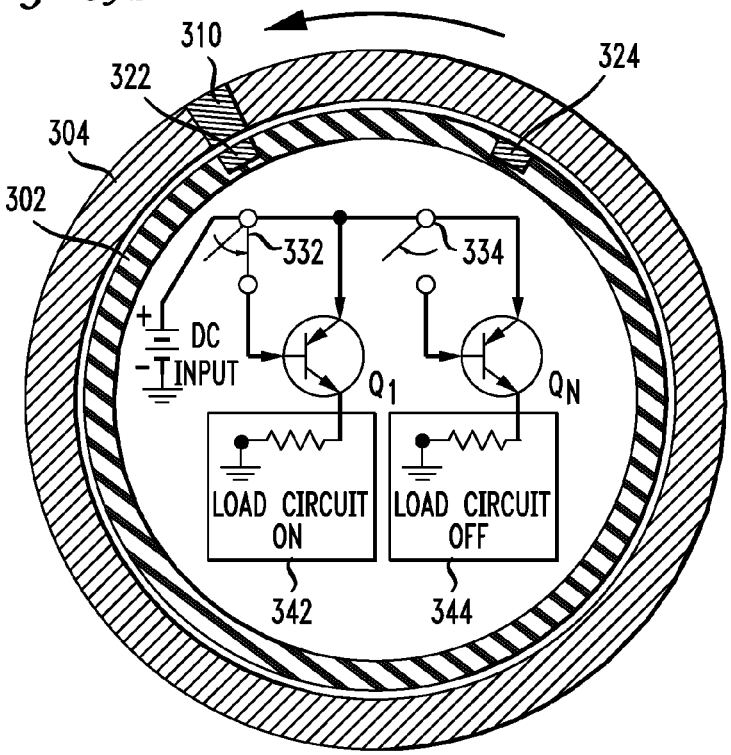
FIGS. 3A and 3B illustrate the example operation of a switch activation element with switches contained in a housing.
Figure 3B:
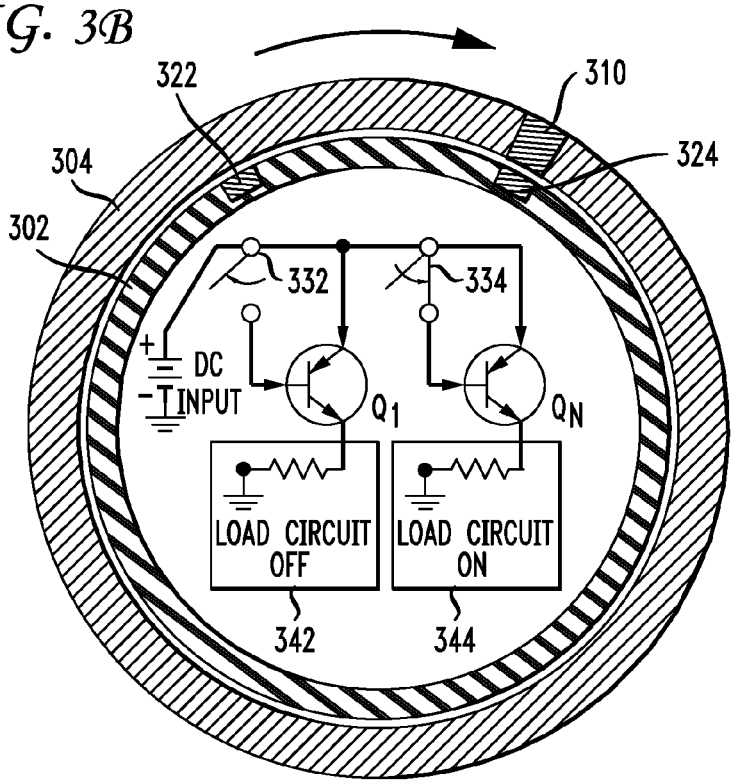

FIGS. 3A and 3B illustrate the example operation of a switch activation element with switches contained in a housing. As illustrated, housing 302 contains load circuits 342 and 344 that are selectively driven upon activation of magnetic switches 332 and 334, respectively. Activation of magnetic switches 332 and 334 is based on the relative position of activation magnet 310 that is fixed in switching ring 304. In one embodiment, magnetic reed switches 332 and 334 are positioned near the perimeter of a circular PC board, thereby enabling discrete activation upon the movement of a switch activation element in switching ring 304.

As illustrated in FIG. 3A, switching ring 304 has been rotated in such a manner that activation magnet 310 is positioned at a point near magnetic reed switch 332. In the illustrated embodiment, this positioning is assisted through the use of positioning magnet 322, which serves to temporarily fix the position of switching ring 304 relative to housing 302. In this embodiment, positioning magnet 322 would not be sufficient on its own to activate magnetic reed switch 332. Rather, only the strength of the magnetic field produced by activation magnet 310 when brought into proximity of positioning magnet 322, and hence magnetic switch 332, would be sufficient to activate magnetic switch 332. In the illustrated position of FIG. 3A, activation magnet 310 would be able to activate magnetic reed switch 322 and not magnetic switch 324.

FIG. 3B illustrates the effect of moving switching ring 304 to a new position such that activation magnet 310 is brought into proximity with positioning magnet 324, and hence magnetic reed switch 334. Again, it should be noted that positioning magnet 324 would not be sufficient on its own to activate magnetic switch 334. When activation magnet 310 is brought into proximity to positioning magnet 324, however, magnetic switch 332 would be deactivated while magnetic switch 334 would be activated. The end effect of this change in positioning of switching ring 304 is the driving of load circuit 344 instead of load circuit 342. A different operational mode would therefore result.

In the embodiment of FIGS. 3A and 3B, activation magnet 310 was used as part of the mechanism that positioned switching ring 304 relative to housing 302. In an alternative embodiment, the mechanism for positioning switching ring 304 relative to housing 302 can be independent of activation magnet 310. To illustrate an example of this alternative embodiment, reference is made to FIGS. 4A and 4B, which illustrate a bottom and a side view, respectively, of an embodiment of a switching ring, and to FIGS. 5A and 5B, which illustrate a top view and a side view of an embodiment of a housing.

Figure 4A:
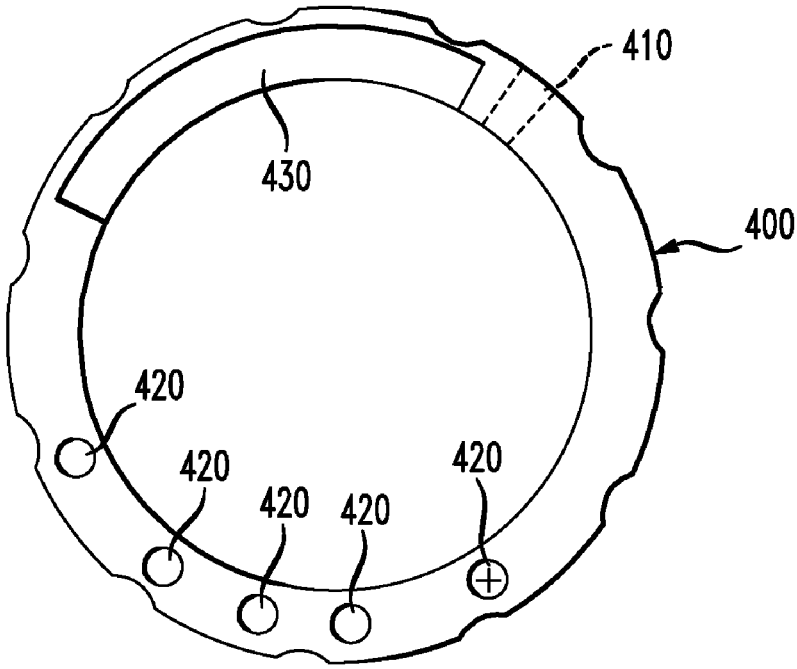
FIGS. 4A and 4B illustrate an example embodiment of a user interface element.

As illustrated in the bottom view of FIG. 4A, switching ring 400 includes activation magnet 410 and separate positioning magnets 420. Activation magnet 410 is positioned in a particular cross section of switching ring 400 that would coincide with a plane of circular PC board 232. This would enable activation magnet 410 to be brought into close proximity to the various magnetic switches that are located around the perimeter of circular PC board 232. In this embodiment, the particular position of switching ring 400 at which activation magnet 410 would be positioned near a particular magnetic switch would be determined by the positioning of one of positioning magnets 420 in proximity to a counterpart positioning magnet located on the housing.

Figure 5A:
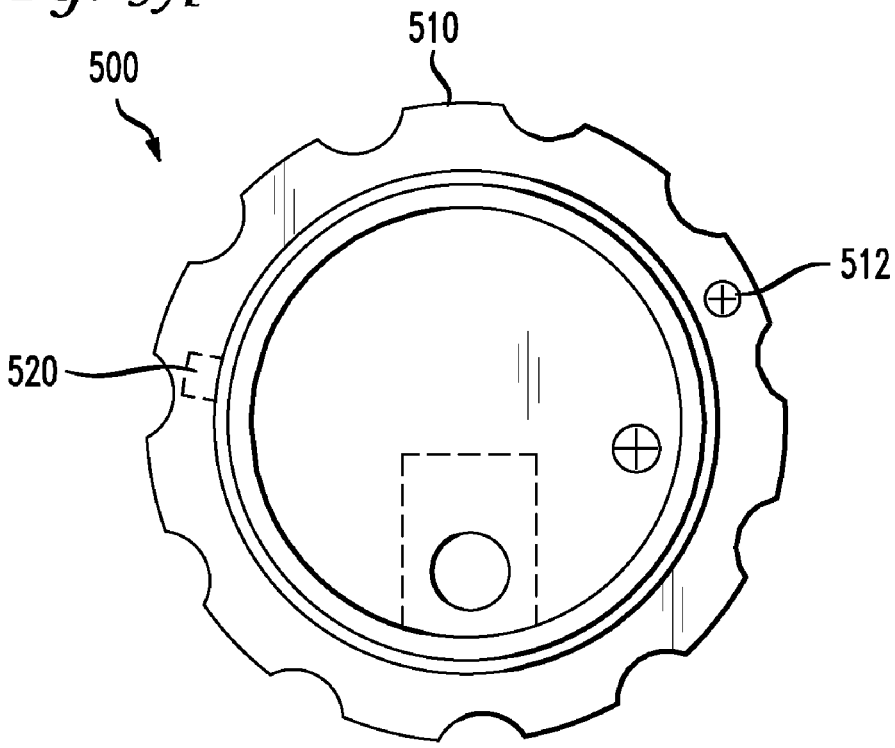
FIGS. 5A and 5B illustrates an example embodiment of a housing.
Figure 5B:
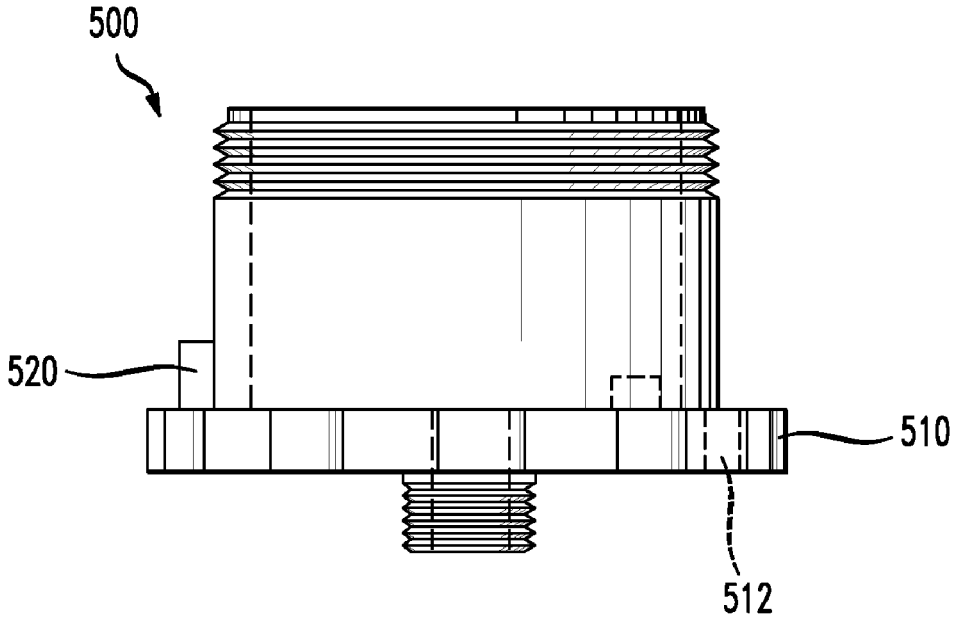

FIGS. 5A and 5B illustrate a counterpart housing 500 that is designed to cooperate with switching ring 400. When assembled, the bottom of switching ring 400, illustrated in FIG. 4A, would rest against end member 510 of housing 500. Incorporated within end member 510 of housing 500 is positioning magnet 512. As switching ring 400 is rotated around the cylindrical portion of housing 500, positioning magnets 420 on switching ring 400 can be selectively engaged with positioning magnet 512 on housing 500. This sequential engagement of positioning magnets 420 on switching ring 400 with positioning magnet 512 would therefore enable the user to control the position of activation magnet 410 relative to the magnetic switches contained in housing 500.

Figure 4B:
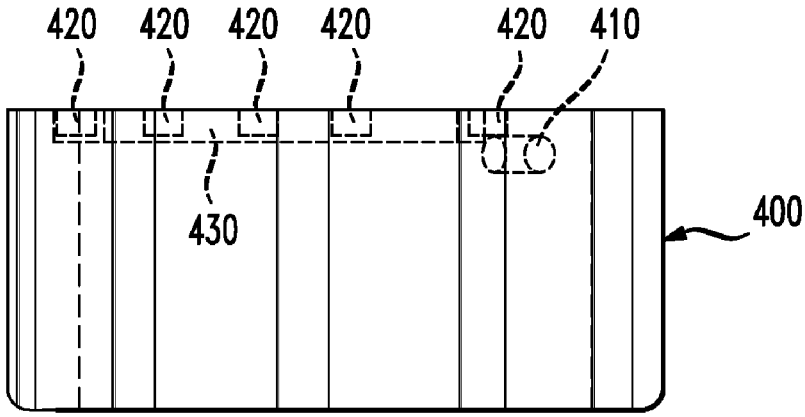

As further illustrated in the embodiment of FIGS. 4A, 4B, switching ring 400 also includes radial support guide 430. In general, radial support guide 430 is designed to receive guide member 520 of housing 500 to thereby define a restricted range of movement of switching ring 400 relative to housing 500. This restricted range of movement would encompass the range of movement needed to enable each of positioning magnets 420 on switching ring 400 to be engaged with positioning magnet 512 on housing 500.

In one embodiment, positioning magnets 420 and 512 and activation magnet 410 can be encased in switching ring 400 and housing 500 to prevent the magnets from being damaged, corroded or clogged.

As thus described, the positioning mechanism can be independent of the activation element. In the example of FIGS. 4A, 4B, 5A, and 5B, this positioning mechanism relied on multiple positioning magnets on switching ring 400 and a single positioning magnet on housing 500. In an alternative embodiment, the positioning mechanism can be based on multiple positioning magnets on the housing and a single positioning magnet on the user interface element.

Figure 6A:
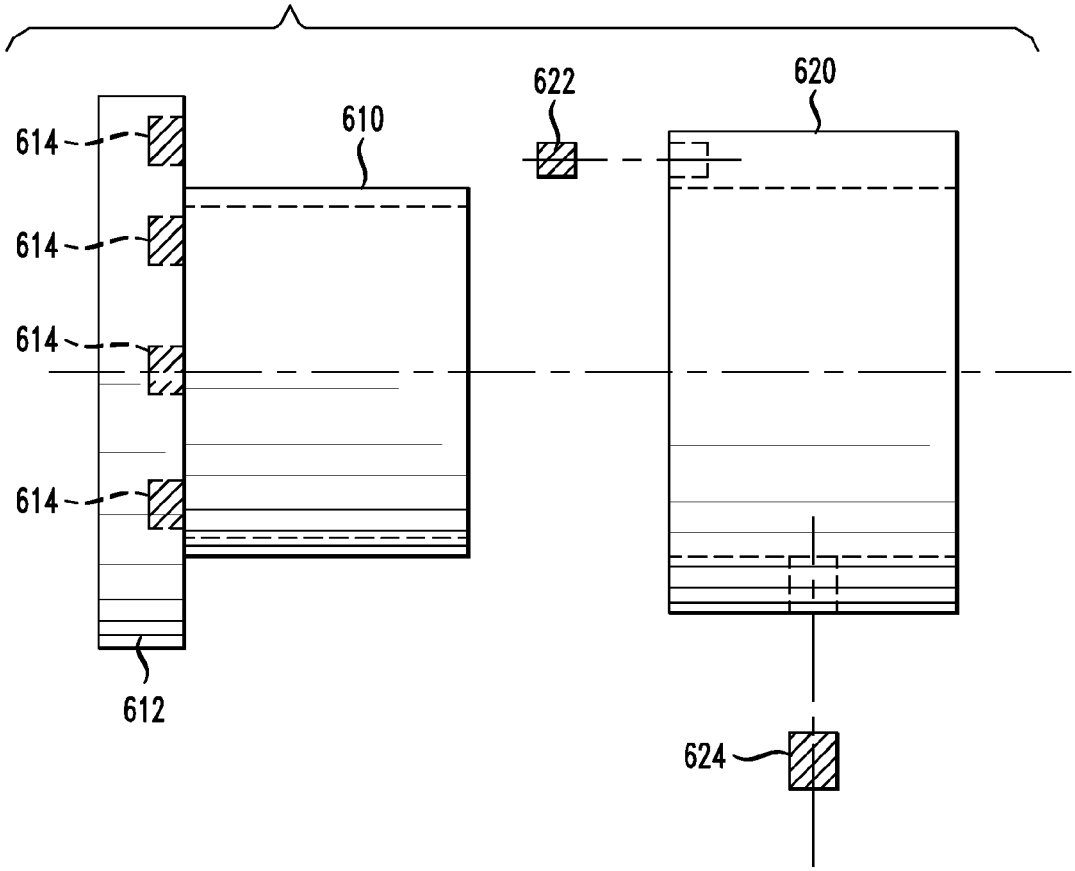
FIGS. 6A, 6B, and 7 illustrate alternative embodiments of a positioning mechanism.
Figure 6B:
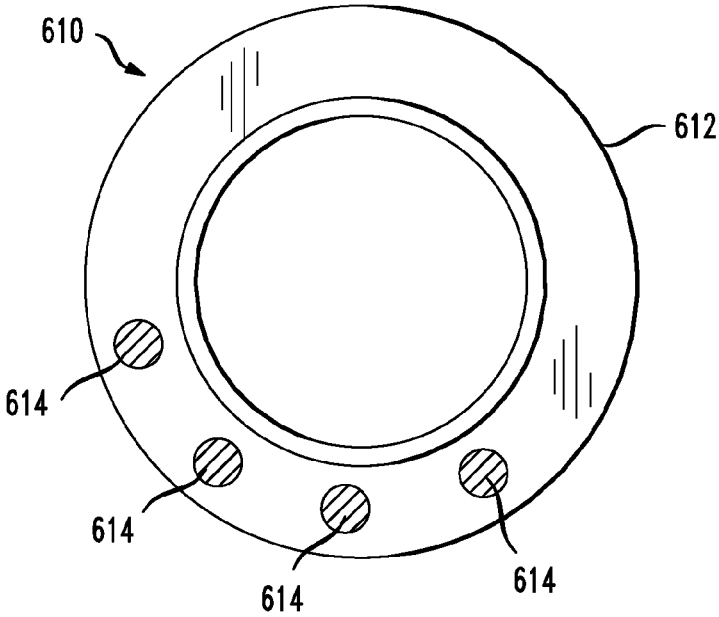

FIGS. 6A and 6B illustrate an example of this embodiment. As illustrated, housing 610 includes positioning magnets 614 that are fixed in end member 612. Positioning magnets 614 are radially distributed around the portion of end member 612 that is adjacent to the end surface of switching ring 620 when switching ring 620 becomes engaged with housing 610. As illustrated in FIG. 6A, positioning magnet 622 is located on the bottom end of switching ring 620 and is designed to move radially around the cylindrical portion of housing 610. As further illustrated in FIG. 6A, switching ring also includes activation magnet 624.

Figure 7:
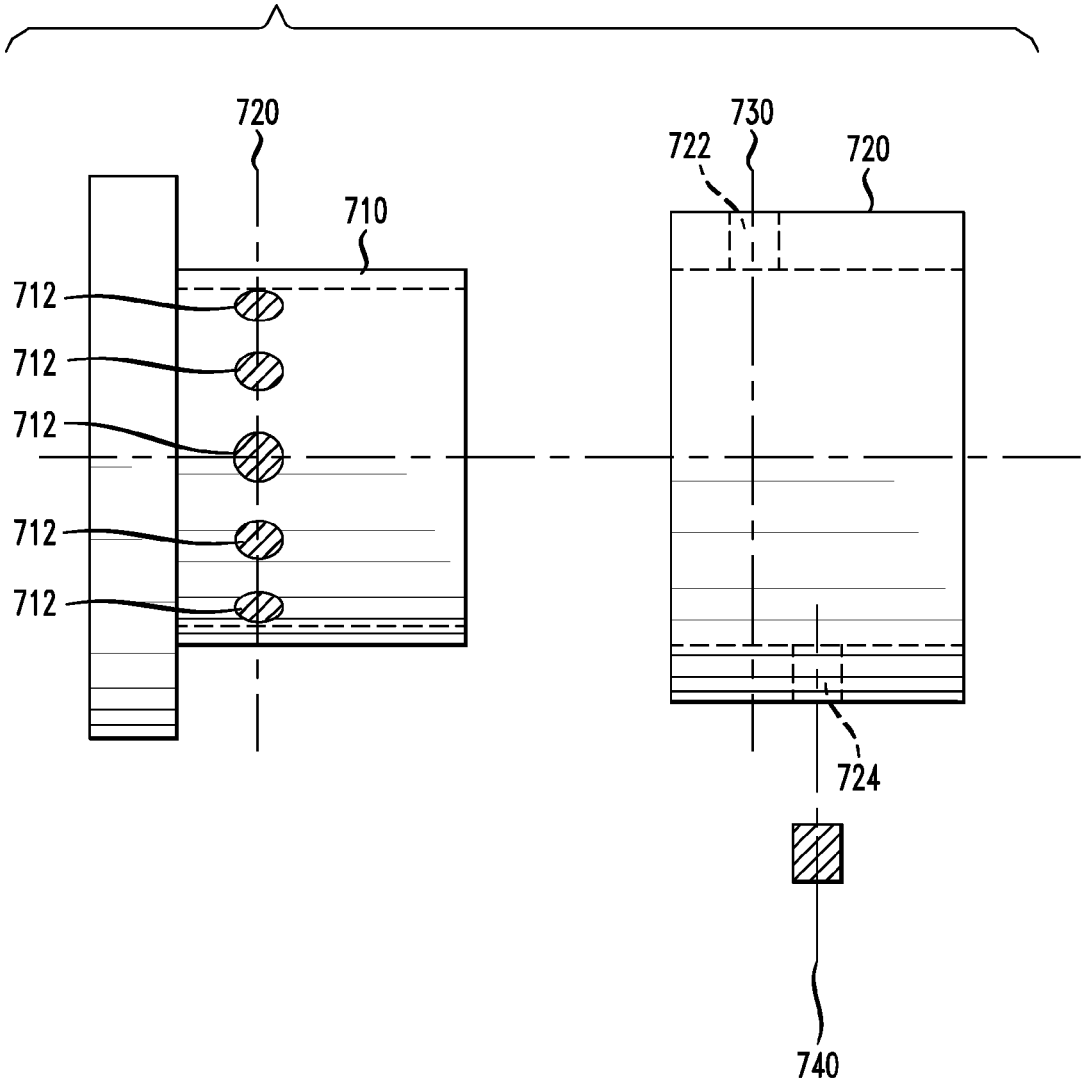

In an alternative embodiment, the positioning magnets on housing 610 can also be moved from the end member 612 of housing 610 to the cylindrical portion of housing 610 around which switching ring 620 rotates. FIG. 7 illustrates an example of this embodiment. As illustrated, housing 710 includes positioning magnets 712 that are located in cross-sectional plane 720. Positional magnets 712 are designed to engage positional magnet 722 that is located in a corresponding cross-sectional plane 740 of switching ring 720. As illustrated, switching ring 720 also includes activation magnet 724 that is located in cross-sectional plane 740 of switching ring 720. As would be appreciated, positioning magnet 722 can also be located in the same cross-sectional plane as activation magnet 724. This embodiment could be supported by a radial support guide such as that illustrated in FIG. 4A to thereby ensure that positional magnets 722 does not interact with magnetic switches contained within housing 710.

While the various embodiments discussed above provide a particular method using magnets to effect positioning of a user interface element relative to the housing, this is not meant to be limiting. As would be appreciated, any mechanism can be used that would enable a user interface element to maintain a sufficiently stable position relative to the housing to thereby enable a non-invasive switch activation mechanism. For example, in an alternative embodiment, a ball and dedent system can be used in place of the positional magnets.

Regardless of the particular positioning mechanism used, a number of predefined positions of the switch activation element relative to the housing can be defined. These predefined positions would correspond to the switch activation element coming into proximity with the various switches contained in the housing. The positions of the switches within the housing also need to be fixed. This can be accomplished through the insertion of the circuit board assembly into the housing in a fixed orientation. In one embodiment, an alignment pin provides a guide by which the circuit board assembly can be inserted into the housing in the proper orientation to thereby ensure that the switches on the circuit board assembly are positioned to interact with the activation element when the user interface element is in one of the positions defined by the positioning mechanism.

Figure 8A:
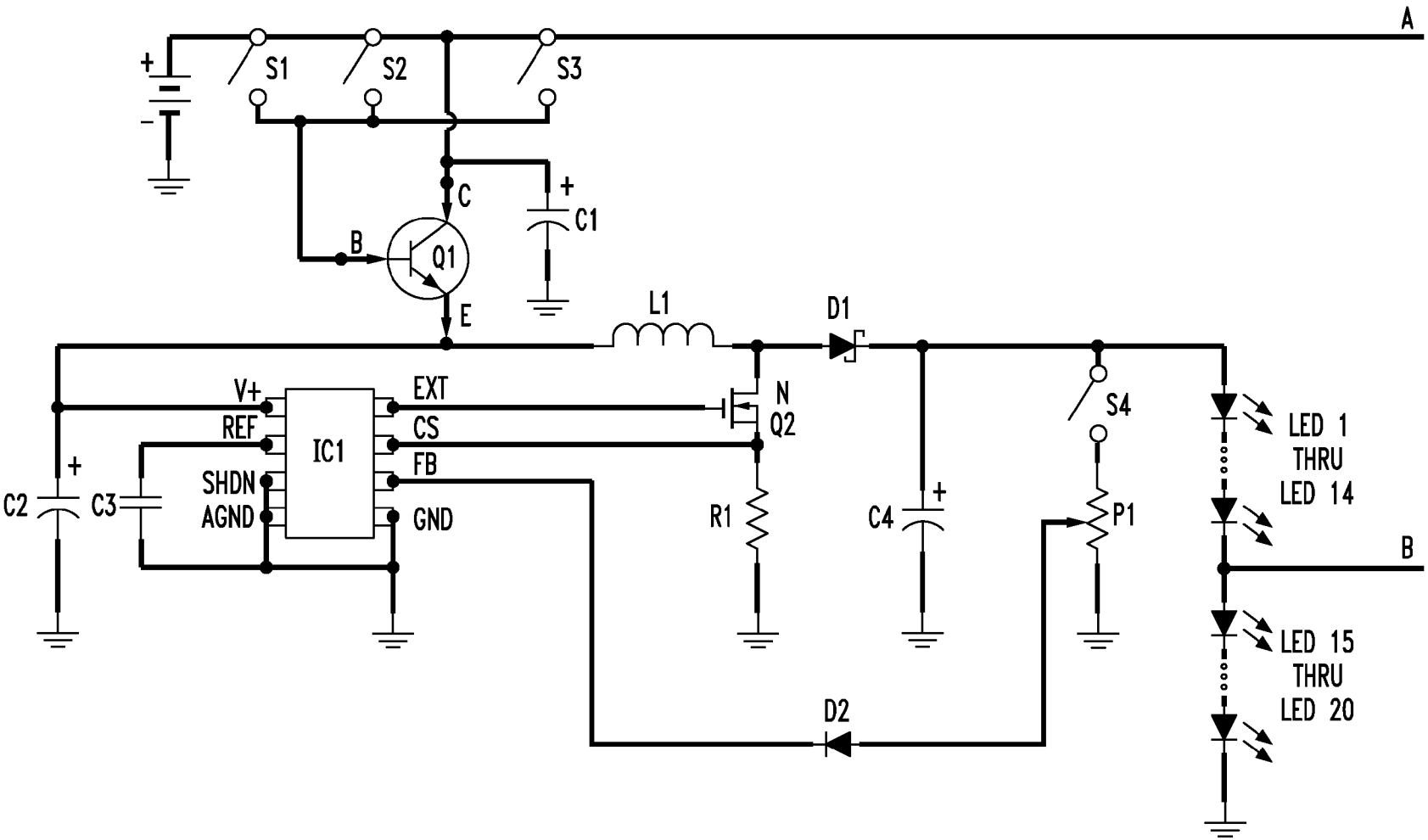
FIGS. 8A and 8B illustrate an embodiment of a light controlling circuit.

An embodiment of a light controlling circuit within the housing is now described with reference to FIGS. 8A and 8B. As illustrated in FIG. 8A, the power for the circuit is supplied from DC source. The power is controlled to the circuit through a series of switches labeled S1 thru S5. In one embodiment, switches S1-S5 are magnetic reed switches. As will be described in greater detail below multiple switches can be used to control a single load, and multiple switches can be used to control multiple loads.

When the magnet housed in the switching ring is positioned at the first stop, switches S1 and S4 are activated. S1 supplies power to the base of transistor Q1 which turns the transistor on. With transistor Q1 turned on, the electricity flows through transistor Q1 to inductor L1 and the DC-DC controller IC 1. Capacitor C1 provides input filtering of the supply power. Capacitor C2 provides additional filtering of the input power that is used to supply IC 1. IC 1 turns transistor Q2 on and off at a particular frequency. In one embodiment, the maximum switching frequency of transistor Q2 is 300 KHz. When Q2 is turned on energy flows from the supply into inductor L1 where the energy is stored. During this time $V_{L1}=V_{IN}$. The load, isolated by schottkey diode D1, is supplied by the charge stored in capacitor C4. When Q2 is turned off, the energy stored in inductor L1 is added to the input voltage and $I_L$ helps supply the load current and restores the energy discharged from capacitor C4. Capacitor C4 supplies current to the load after inductor L1 discharges. When transistor Q2 turns off $V_{L1}=V_O-V_{IN}$. The operating frequency of transistor Q2 is controlled by a feedback loop that samples the output voltage. With switch S4 closed, the output voltage is sampled through a potentiometer P1. Potentiometer P1 acts as a voltage divider. By adjusting potentiometer P1, the output voltage can be adjusted from input voltage to $V_{out}=V_{ref}*(P1_{R2}/P1_{R1}+1)$, where $P1_{R1}$ and $P1_{R2}$ equal the resistance of P1 and $V_{ref}$ equals 1.5V. Capacitor C3 is used to supply IC 1 with a reference voltage.

The current sense resistor R1 sets the maximum output current, $$R_1 = \frac{0.00126\ \mathrm{V} * V_{in}}{V_{out} * I_{out}}$$

where R1 is equal to the current sense resistor, $V_{in}$ is equal to the input voltage, $V_{out}$ is equal to the output voltage and $I_{out}$ is equal to the maximum output current.

When the magnet is moved to switch position two, switch S2 is closed while switches S1, S3, S4 and S5 are left open. The circuit operates the same as above, except the feedback circuit is disabled. With the feedback circuit disabled, IC 1 operates at the maximum frequency (e.g., 300 Khz). The output voltage is given by:

$$V_{out} = \frac{Eff * V_{in} * I_{in}}{I_{out}}$$

where $V_{out}$ equals the output voltage, Eff equals the efficiency of the circuit, $V_{in}$ equals the input voltage, $I_{in}$ equals the input current, and $I_{out}$ equals the output current. The load on this circuit cannot exceed the efficiency of the circuit times the power input.

When the magnet is moved to position three, switch S5 is closed while switches S1, S2, S3 and S4 are open. Switch S5 supplies voltage to the gate of transistor Q3 from a voltage tap that is between LED 14 and LED 15. With transistor Q3 turned on power is supplied to the DC-DC controller IC 2 and inductor L2. Capacitor C1 provides input filtering of the supply power. Capacitor C5 provides additional filtering of the input power that is used to supply IC 2. IC 2 turns transistor Q4 on and off at a particular frequency. In one embodiment, the maximum switching frequency is 300 KHz. When transistor Q4 is turned on energy flows from the supply into inductor L2 where the energy is stored. During this time $V_{L2}=V_{IN}$. The load, isolated by schottkey diodes D3, D4 and D5, is supplied by the charge stored in capacitor C7. Schottkey diodes D3, D4 and D5 are used instead of a single high current diode due to the voltage drop associated with a single diode. When transistor Q4 is turned off, the energy stored in inductor L2 is added to the input voltage and $I_{L2}$ helps supply the load current and restores the energy discharged from capacitor C7. Capacitor C7 supplies current to the load after inductor L2 discharges. When transistor Q4 turns off $V_{L2}=V_O-V_{IN}$. The operating frequency is controlled by a feedback loop that samples the output voltage. The output voltage is sampled through a potentiometer P2. Potentiometer P2 acts as a voltage divider. By adjusting potentiometer P2, the output voltage can be adjusted from input voltage to $V_{out}=V_{ref}*(P2_{R2}/P2_{R1}+1)$, where $P2_{R1}$ and $P2_{R2}$ equal the resistance of P2 and $V_{ref}$ equals 1.5V. Capacitor C6 is used to supply IC 2 with a reference voltage.

The current sense resistors R2 and R3 set the maximum output current, $$\frac{1}{R_2}+\frac{1}{R_3}=\frac{0.075\ \mathrm{V}*V_{in}}{V_{out}*I_{out}}$$

where R2 and R3 are equal to the current sense resistors, $V_{in}$ is equal to the input voltage, $V_{out}$ is equal to the output voltage and $I_{out}$ is equal to the maximum output current.

The current sense resistor R1 sets the maximum output current. When voltage is applied to the gate of transistor Q3, diode D6 slowly drains capacitor C4. The size of capacitor C4 determines the length of time that transistor Q3 remains turned on. Also when switch S5 is opened, diode D6 drains the gate of transistor Q3 to provide for a means of shutting transistor Q3 off.

Initially, when voltage is applied to the gate of transistor Q3, the step-up converter does not boost the voltage above the supply voltage when the supply voltage of the battery is at or above the nominal open circuit voltage of the battery. By turning the switching ring to position 2 or 4 then back to position 3, this allows the DC-DC step-up circuit to boost the output voltage to the preset voltage as determined by potentiometer P2. This scheme provides the means to allow for two output settings built into one circuit.

When the supply voltage is below the nominal open circuit voltage of the battery the circuit boosts the output voltage to 90% of the high setting of the boost circuit.

When the magnet is moved to position four, switches S3 and S5 are closed while switches S1, S2, and S4 are open. This allows for both the LED and spot bulb circuit to operate simultaneously. The LED circuit operates with the feedback circuit disabled and the spot bulb circuit operates at the high setting.

In one embodiment, all of the components for the circuits are plugged into the PC board. This allows for customization of the circuit easily to accommodate for a variety of light outputs desired. The light output can be changed both in intensity, by adding additional LED's, or wavelength of emitted light, by changing LED types. The light can accommodate any wavelength LED from infrared to ultra violet.

In one embodiment, a color balanced LED array is used. For example, one color-balanced LED array can include yellow LEDs amongst a set of white LEDs to produce a color-balanced light output. This color balanced light output has been shown to produce better depth perception and clarity to a user. As would be appreciated, the value of a color balanced light output would be felt in any appropriate lighting application, whether or not a portable light was required.

In general, there are two problems that arise from the use of a LED array. First the power must be distributed evenly to each LED in the array. Conventional designs run parallel strings of LED's, which are in series. The problem with this scheme is that the LED's in the middle of the array tend to heat up and their resistance drops, thereby causing more current to flow through that particular LED string. Second, the LED wavelength type is fixed. This means that the user would have to custom order a particular LED combination or try and unsolder the LED's and replace them with the combination that suits their needs. Two problems arise from the user trying to replace the fixed LED's. First, the LED's need to be soldered, which can over heat and damage the LED. Second, the load must be balanced between the parallel LED strings.

Current light designs also try to add a spot bulb to overcome the LED's inability to project a concentrated beam of light any reasonable distance. Two solutions have been proposed to overcome this problem. First, the spot bulb is mounted to the side of the LED array. This causes the light pattern from the spot bulb to be offset from the LED array. Second, the LED's are embedded into the reflector of the spot bulb. This causes the light pattern from the spot bulb to be diffused.

In addition to the light-pattern problem, the spot bulb of conventional designs do not have any power management scheme. This means that the spot bulb runs directly from the input supply. Two problems arise from this scheme. First, the light output decreases as the battery voltage decreases. Second, the light output is limited to a maximum output due to the battery's fixed maximum voltage.

To solve some of the above problems circular PC board 234 has been provided that includes sockets that are wired in series around the circumference of a parabolic reflector 254 used for the spot bulb. With this arrangement, the user can easily change the LED's to suit the wavelength requirement. All that is needed to accomplish this task is to plug in the desired LED into the socket. There is no need to balance the load because the LED's are wired in series, thereby ensuring that there is equal current supplied to each LED. Additionally, the LED's light pattern is concentric with the spot bulb. Finally, since the LED's do not interfere with parabolic reflector 254, the light pattern from the spot bulb is not compromised.

Figure 8B:
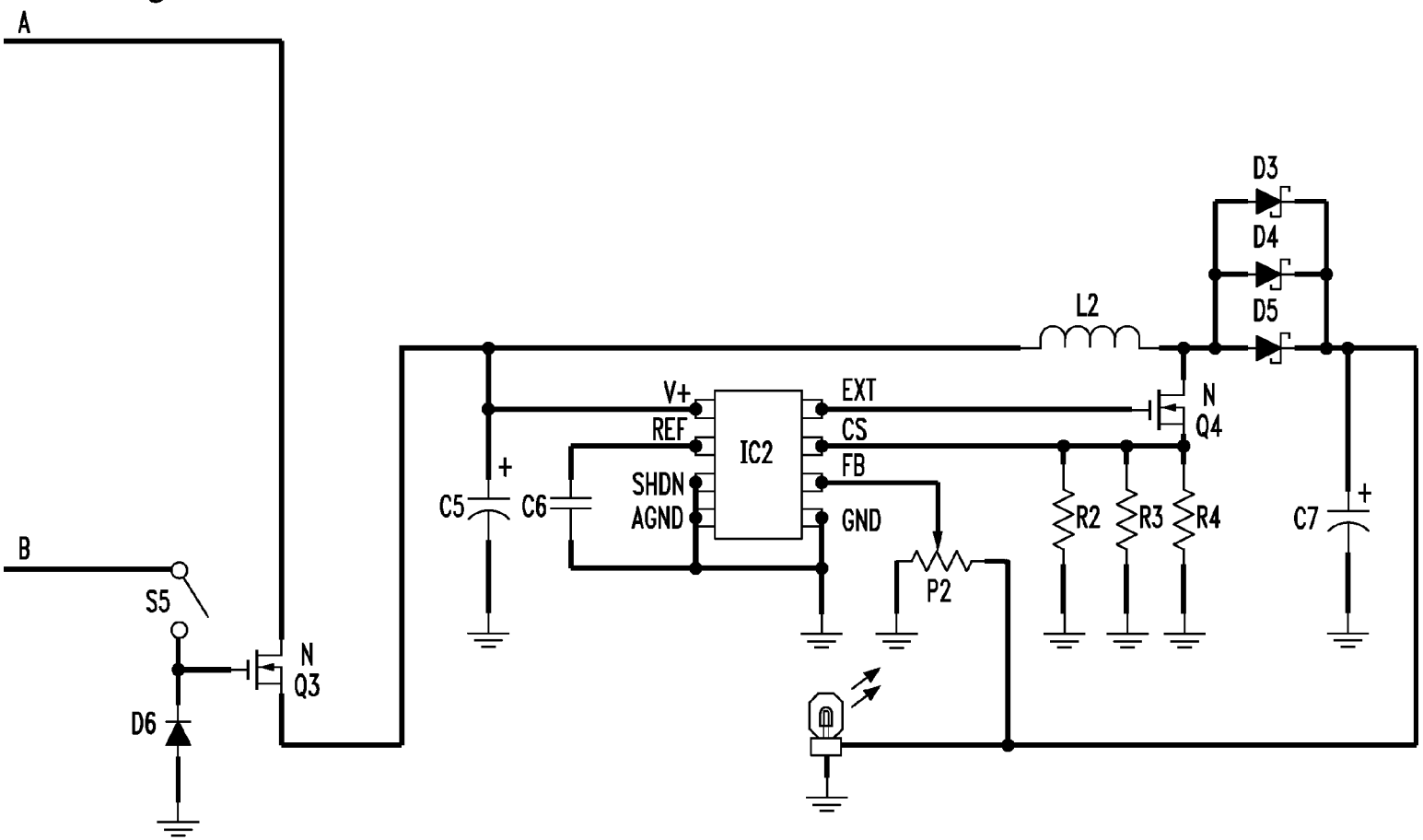

To solve the problem associated with a fixed maximum voltage supplying the spot bulb, the circuit of FIGS. 8A and 8B include a DC-DC switching power supply powering the spot bulb. This allows for the spot bulb to operate at the battery voltage and at a voltage above the supply voltage. The user can then select the voltage setting above the supply voltage. This allows for a custom light output for the spot bulb.

In one embodiment, as an alternative to a spot bulb, an additional LED array can be directly plugged into the spot bulb socket. The only adjustment that is needed is for the output voltage to be increased sufficiently to power the additional LED array.

To solve the problem of a fixed input to the switching power supply the inductor is plugged into a socket in the circuit board. By changing the inductor size, the user can select the voltage of the battery that will be used to operate the light. By selecting the input the user can then select the type of battery that will suit the users requirements.

In addition to the portable light uses described above, the non-invasive switch mechanism can also be applied in other contexts where a simple switch user interface is required or where the sealed nature of the switch is required.

Figure 9:
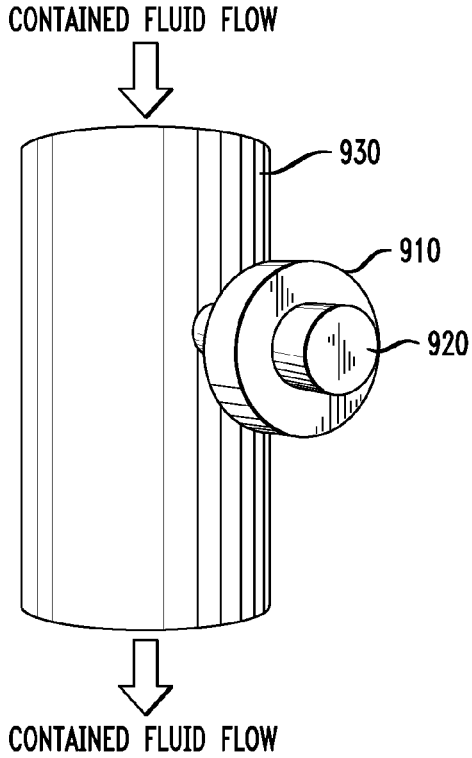
FIGS. 9 and 10 illustrate alternative uses of the switching mechanism of the present invention.

FIG. 9 illustrates one example of an alternative use in the fluid or gas containment area. As illustrated, switching ring 910 can be coupled to a housing portion 920 that is exposed to a fluid or gas substance that must be contained. Housing portion 920 can be designed to house electronics or other measurement circuitry that, for example, can be designed to measure characteristics of the substance in pipe 930 or a rate of movement of the substance in pipe 930. Using a switch mechanism of the present invention, control signals can be sent to electronics or other control apparatus within housing 920 without risking a breach of containment of pipe 930.

Figure 10:
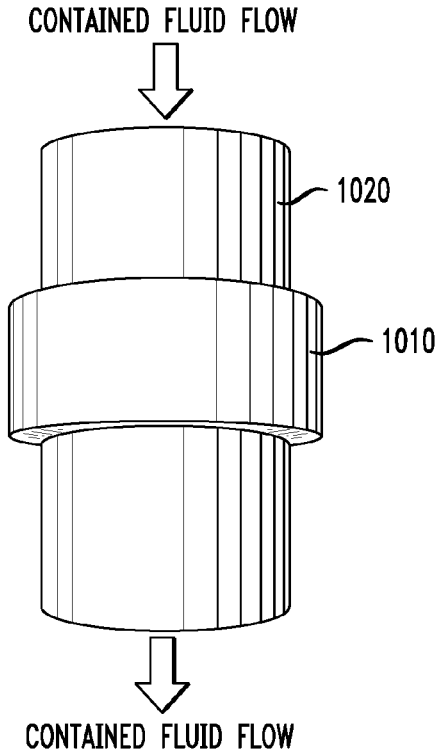

FIG. 10 illustrates an alternative embodiment of an application within this area. As illustrated, switching ring can be designed to surround pipe 1020 to thereby control measurement apparatus within pipe 1020. In one example, this measurement apparatus could be used to directly measure the flow of a liquid within pipe 1020.

As would be appreciated, the principles of the present invention can be applied in a variety of contexts and in a variety of use situations. Indeed, the intended application will dictate the need to incorporate one or more of the features described above. For example, if the lighting system is not designed to be portable, a sealed housing may not be required. Rather, the simple user interface and color balanced LED feature may be sufficient for that application.

Although the above description may contain specific details, they should not be construed as limiting the claims in any way. Other configurations of the described embodiments of the invention are part of the scope of this invention. Accordingly, the appended claims and their legal equivalents only should define the invention, rather than any specific examples given.

What is claimed is:

1. A switching system, comprising:

a housing containing a powered device, wherein a portion of said housing is cylindrical in shape, said housing including an activation element;

a switch interface ring element, which includes a positioning element, that is designed to rotate radially around said cylindrical portion of said housing in a substantially fixed position along an axis of said rotation; and a magnet movable by said switch interface ring element, said magnet activating said activation element within said housing when said switch interface ring element is rotated radially around said housing to a position determined by said positioning element such that said magnet is brought in proximity to said activation element, said activation element being used to control said powered device.

2. The switching system of claim 1, wherein said powered device is an electronic device.

3. The switching system of claim 1, wherein said powered device is a light.

4. The switching system of claim 1, wherein said activation element is a magnetic switch element.

5. The switching system of claim 1, wherein said switch interface ring element has a plurality of magnets fixed thereon.

6. The switching system of claim 1, wherein said positioning element is fixed on a surface of said switch interface ring element.

7. The switching system of claim 1, wherein said positioning element is fixed inside said switch interface ring element.

8. A control system, comprising:

a control interface ring element designed to rotate radially around a cylindrical portion of a housing in a substantially fixed position along an axis of said rotation; and a positioning element supported by said control interface ring element, said positioning element identifying a position of said control interface ring element relative to said housing such that a magnet supported by said control interface ring element is brought into proximity to an activation element contained within said housing when said control interface ring element is brought into said position, said magnet activating said activation element when said magnet is brought into proximity to said activation element.

9. The control system of claim 8, wherein said activation element controls a function of an electronic device.

10. The control system of claim 9, wherein said electronic device includes a light.

11. The control system of claim 8, wherein said activation element is a magnetic switch element.

12. The control system of claim 8, wherein said control interface ring element has a plurality of magnets fixed thereon.

13. The control system of claim 8, wherein said positioning element is fixed on a surface of said control interface ring element.

14. The control system of claim 8, wherein said positioning element is fixed inside said control interface ring element.

15. A control system, comprising:

a control interface ring element that rotates radially around a cylindrical portion of a housing in a substantially fixed position along an axis of said rotation, wherein movement of said control interface ring element to a defined position enables activation of a magnetic switch element within said housing by a magnet brought into proximity to said magnetic switch element.

16. The control system of claim 15, wherein said defined position is identified using a positioning element in said control interface ring element.

17. The control system of claim 16, wherein said positioning element is a magnet.

18. The control system of claim 16, wherein said positioning element is part of a ball and detent mechanism.

* * * * *